US006047585A

United States Patent [19]

Haslinger

[11] Patent Number: 6,047,585

[45] Date of Patent: Apr. 11, 2000

[54] APPARATUS FOR SHAPING WORKPIECES

[75] Inventor: Engelbert Haslinger, Salzburg, Austria

[73] Assignee: GFI Fertigungstechnik GmbH, Linz, Austria

[21] Appl. No.: 09/171,057

[22] PCT Filed: Sep. 24, 1996

[86] PCT No.: PCT/EP96/04176

§ 371 Date: Dec. 29, 1998

§ 102(e) Date: Dec. 29, 1998

[87] PCT Pub. No.: WO97/38806

PCT Pub. Date: Oct. 23, 1997

[30] Foreign Application Priority Data

Apr. 12, 1996 [DE] Germany ..... 196 14 517

[51] Int. Cl.[7] ..... B21D 7/02

[52] U.S. Cl. ..... 72/214; 72/220; 72/316; 72/322

[58] Field of Search ..... 72/214, 217, 220, 72/316, 322, 293, 311, 318, 319

[56] References Cited

U.S. PATENT DOCUMENTS

| | | | |
|---|---|---|---|
| 2,175,679 | 10/1939 | Beatty . | |
| 2,476,596 | 7/1949 | Green | 72/322 |
| 5,765,427 | 6/1998 | Codatto | 72/322 |

FOREIGN PATENT DOCUMENTS

| | | | |
|---|---|---|---|
| 4009466A1 | 9/1991 | Germany . | |
| 5-76940 | 3/1993 | Japan | 72/217 |

*Primary Examiner*—Ed Tolan

*Attorney, Agent, or Firm*—Jordan and Hamburg LLP

[57] ABSTRACT

An apparatus for shaping panel-shaped workpieces uses an hourglass-shaped roller as bending tool. The workpieces are clamped between a first and a second tool. The second tool has a holding-down surface. Superimposed vertical side surfaces of the tools are offset by a horizontal dimension X, which corresponds at most to five times the thickness of the panel-shaped workpiece. The second tool is inclined and forms a further vertical surface in a region in which the panel-shaped workpiece is shaped into a comer and in which the tool does not cover the workpiece.

7 Claims, 4 Drawing Sheets

APPARATUS FOR SHAPING WORKPIECES

BACKGROUND OF THE INVENTION

The invention relates to an apparatus for shaping workpieces that are generally are panels, sheet metal, foil or sheeting, which are disposed in such a manner between two tools, that a part to be shaped is not covered by the tools. After the workpieces are fixed, shaping work, such as bending work, is carried with a third tool.

Apparatuses are known which carry out shaping work (bending work) on workpieces which are clamped between two working panels. The clamping usually is mechanical, for example, by G clamps or cheek plates, which are disposed so that they can be moved hydraulically towards one another. The shaping, which is to be brought about by the bending work, generally is carried out by dies or bottom dies. Likewise, for the shaping of less complex formations, as required for profiles or chamfers, so-called "free bending" is carried out. Free bending, however, permits only a limited degree of complexity. An apparatus for carrying out such a method is known from the German patent 40 09 466. The method described there offers the possibility, after a particular adjustment of the tool, of producing a particular type of corner using a particular sheet metal. The pre-setting of the tool must be taken into consideration already when the tool is manufactured, since later modifications, which may be required for other workpieces (workpiece thickness, edge height, characteristic values of the material), cannot be carried out.

Moreover, this patent discloses an apparatus for bending and profiling corners, a tool for holding down the workpiece being used to lock the workpieces in position. The basic shape of this holding-down device is rectangular, so that it covers completely the region of the corner of the workpiece. However, due to the complete coverage of the corner region, stretching of the material in this region is prevented, so that cracks, which are not acceptable for esthetic as well as safety reasons, can develop in the comer region.

SUMMARY OF THE INVENTION

It is an object of the invention to provide an apparatus for shaping workpieces, which enables the tool geometry to be modified with respect to the workpieces that are to be shaped and permits a reliable, qualitatively high-grade corner profiling.

Pursuant to the invention, this objective is accomplished by providing an hourglass-shaped roller as bending tool. Workpieces in each case are clamped between a first and a second tool, the second tool having a holding-down surface. The invention is characterized in that superimposed vertical side surfaces of the workpiece are offset by a horizontal dimension X, which corresponds at most to five times the thickness of the panel-shaped workpiece, and in that the second workpiece, having the holding-down surface, is inclined and forms a further vertical surface in a region A, in which the panel-shaped workpiece is to be shaped into a corner and in which the tool does not cover the workpiece.

The present invention also provides a that the dimension X, as a distance between the molded edge and the vertical surface, can be adjusted as a function of the thickness and edge height of the workpiece.

According to a feature of the invention, there is further provided that the holding surface of the second tool has a plastic coating or consists of a metallic material and is flat. The plastic coating optionally consists of polyethylene.

The present invention further provides that the end region of the holding surface is inclined in such a manner, that the free edge is at a lesser distance Z from the workpiece.

The present invention is further characterized by a feature that the second tool can be shifted exclusively in the vertical direction.

Since the second tool is equipped with a longitudinal displacement device (hydraulic or pneumatic) and only a displacement in the intended direction is desired, the second tool has a device, which prevents a twisting or displacement of the second tool in a direction, which does not correspond to the intended direction of displacement by the longitudinal displacement mechanism.

Furthermore, at the second tool, the apparatus for shaping workpieces has a contour, which permits workpieces to be clamped without damage to the material of the workpiece; however, the underside of the second tool can also be constructed flat, if the workpiece material is very hard. A flat underside is also advantageous if the workpiece has a low hardness, since in this case a plastic coating on the underside prevents damage to the surface.

A further advantage of the present invention is that the surface is formed in the vicinity of the molded edge such that a certain region of the workpiece is not subjected to the clamping force, so that the region, which is not covered, can be shaped in accordance with the force applied by the hourglass roller. In particular, the present invention offers the advantage that the shaping work, particularly the corner profiling, can be carried out with high precision and speed.

A further advantage of the inventive apparatus consists of the possibility of varying the dimension X, which corresponds to the lateral horizontal distance between the two vertical surfaces of the two tools, which are closest to the hourglass-shaped roller, in accordance with different characteristic values of the material, such as the thickness of the workpiece, the edge height, the grain size, etc., in order to achieve a reliably high shaping quality.

By recesses in the corner region of the workpiece, which is to be shaped, as well as by the modular properties of the two tools, which act as holding-down tools, it is possible to adapt the dimensions of the tool optimally to the characteristic values of the workpiece. It has proven to be particularly advantageous to adjust the lateral distance between the molded edge and the holding edge of the first and second tools concertedly by a provided pre-setting of the tools or by a device, which permits an adjustment even during the production process, since this lateral distance affects the quality of the shaping. This lateral distance should be less than or equal to five times the thickness of the workpiece. If this lateral distance is larger, the region of the sheet metal, which is to be shaped, yields in the upward direction and causes a curvature, which is not desirable. Likewise, the edge height (that is, the length of the region of the workpiece protruding beyond the first tool) is of decisive importance for evaluating and coordinating the lateral distance, since this region of the workpiece, during the shaping, experiences a high mechanical stress, which can bring about a curvature.

TABLE 1

| | | | | | | | | |
|---|---|---|---|---|---|---|---|---|
| S(mm) | 0.5 | 1.0 | 1.5 | 2.0 | 2.5 | 3.0 | 3.5 | 4.0 |
| X(mm) | 0.6 | 1.1 | 2.1 | 2.6 | 3.1 | 3.6 | 4.1 | 4.6 |

Table 1 shows an example for assigning a value X (distance between the molded edge and a tool) to S (thickness of the workpiece) for the present invention in order to achieve a high quality of shaping of the workpieces.

A metallic material, such as steel or a steel alloy, is particularly suitable for constructing the holding-down device. It is, however, also possible to coat the underside of the holding-down device with plastic. This has the advantage that the workpieces, which consist of softer materials, such as aluminum, are not deformed unintentionally by the plastic surface coating at their surface, as would be the case with a metallic hard surface. In the case of very hard or ductile workpieces, it is, however, also possible to provide the whole of the underside of the holding-down device with a very hard metallic layer or to harden such a surface (for example, by nitriding, laser surface hardening, carburizing, etc.).

The apparatus is used for bending methods, the processing temperature of which, on the basis of the characteristic value of the material, lie below the recrystallization temperature of the material of the workpiece, so that the shaping is a cold forming.

BRIEF DESCRIPTION OF THE DRAWINGS

In the following, an example of the invention is described in greater detail by means of drawings, in which.

DETAILED DESCRIPTION OF THE PREFERRED EMBODIMENT

Figure 1:
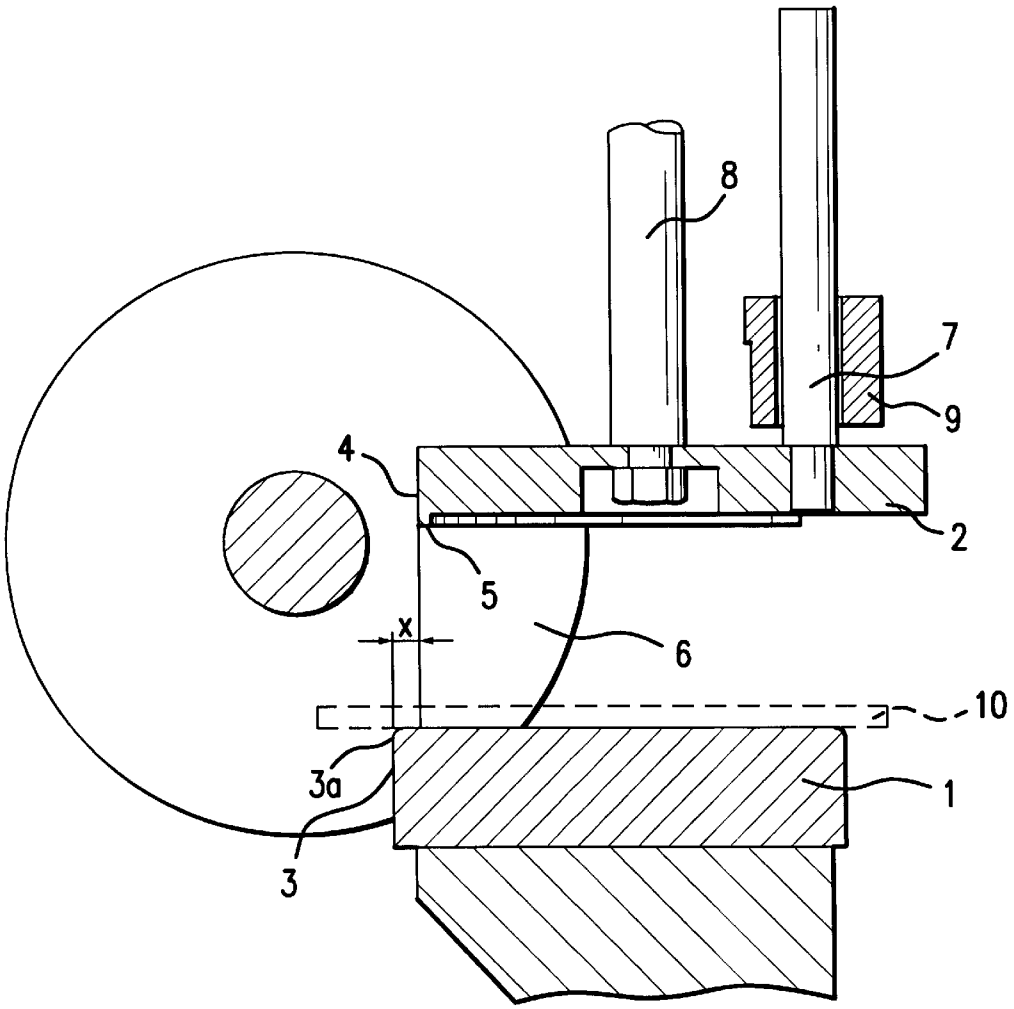
FIG. 1 shows a partially sectional view of an embodiment of the present invention with two tools, used for the clamping, and of a shaping tool constructed in the form of a roller.

FIG. 1 shows a second tool 2 with a contour in A region 5 and a first tool 1, as well as a workpiece 10, which is disposed above tool 1 and a region of which, which is to be shaped, protrudes over a molded edge 3*a*, which terminates a side surface 3 in the upwards direction. A further tool 6 is shaped like an hourglass roller, which is moved during the bending process along the side surface 3, in order to shape the workpiece 10 thus in conformity with the contour of the molded edge 3*a* or the side surface 3. The distance X, which determines the quality of the shaping, is attained by an adjusting device (FIGS. 2; 2*a*), which is mounted on the holding-down device. The seat for and the movability of the second tool 2 is realized by a cylindrical device 8, preferably of a hydraulic type (likewise, a pneumatic device or a device controlled by a toothed linkage, can also be used). Because of the one-point support for the second tool 2, a device is required, which guides the tool so that only the one desired degree of freedom—shifting in one direction—is retained. In FIG. 1, this is achieved with a cylinder 7, which is disposed parallel to cylinder 8 and runs in a guide 9.

Figure 2:
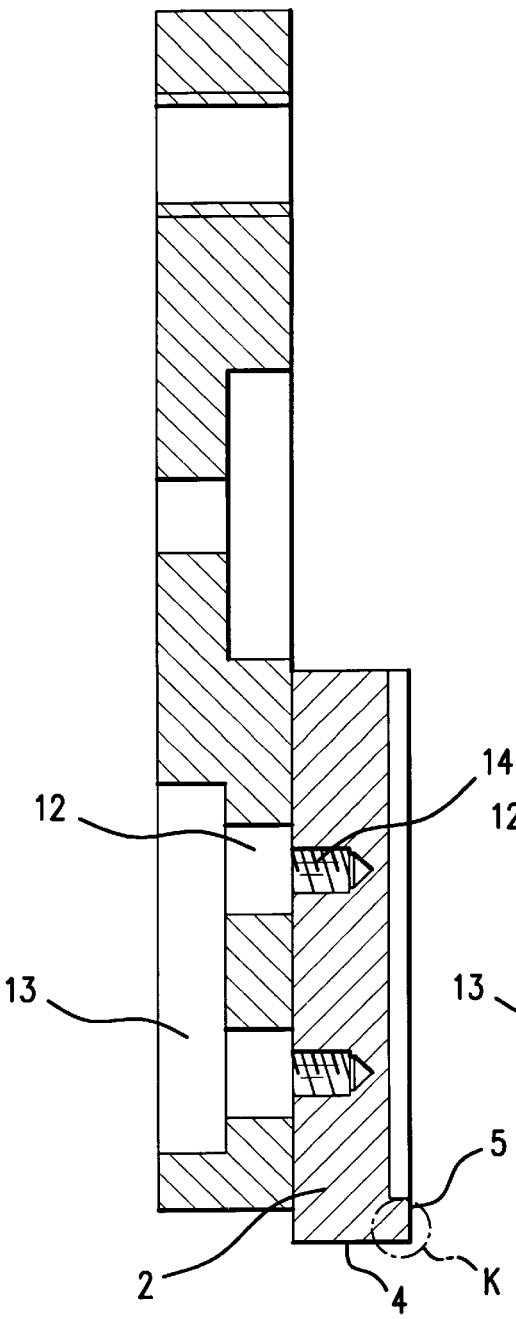
FIG. 2 shows a side view of a second tool with integrated adjustment possibilities for the lateral distance X, and a holding surface consisting of a metallic material.

FIG. 2 shows a diagrammatic cross section through a second tool, which consists of two parts, the device for adjusting the distance X being integrated in the tool head of the second tool. The adjustability is realized by an elongated borehole 13, located in an upper side of the tool 2, in conjunction with blind holes 14, which are provided with a thread and disposed below in the actual holding tool 2, in that the screws, guided by the elongated borehole 13, have play in the guides 12, which permits the lower part of the second tool 2 to be shifted perpendicularly to the axes of the screws. For adjusting the distance X, the screws, located in the blind holes 14, are loosened and the lower region of the second tool is adjusted according to the values given in Table 1. Due to the line of symmetry of the elongated hole, which is disposed at an angle of 45° to the side edge 3, a simultaneous, identical alignment is attained in both horizontal directions (see FIG. 5). For comer angles, which are not 90°, the angular alignment changes in correspondence with the bisector of the corner angle (110° to 55°; 120° to 60°, etc.). Furthermore, FIG. 2 shows the basic arrangement of the bearings of the force-applying cylinder 8 and of the twisting and shifting device 9, which is secured by a thread. The detail, labeled K, is shown on a larger scale in FIG. 3.

Figure 2A:
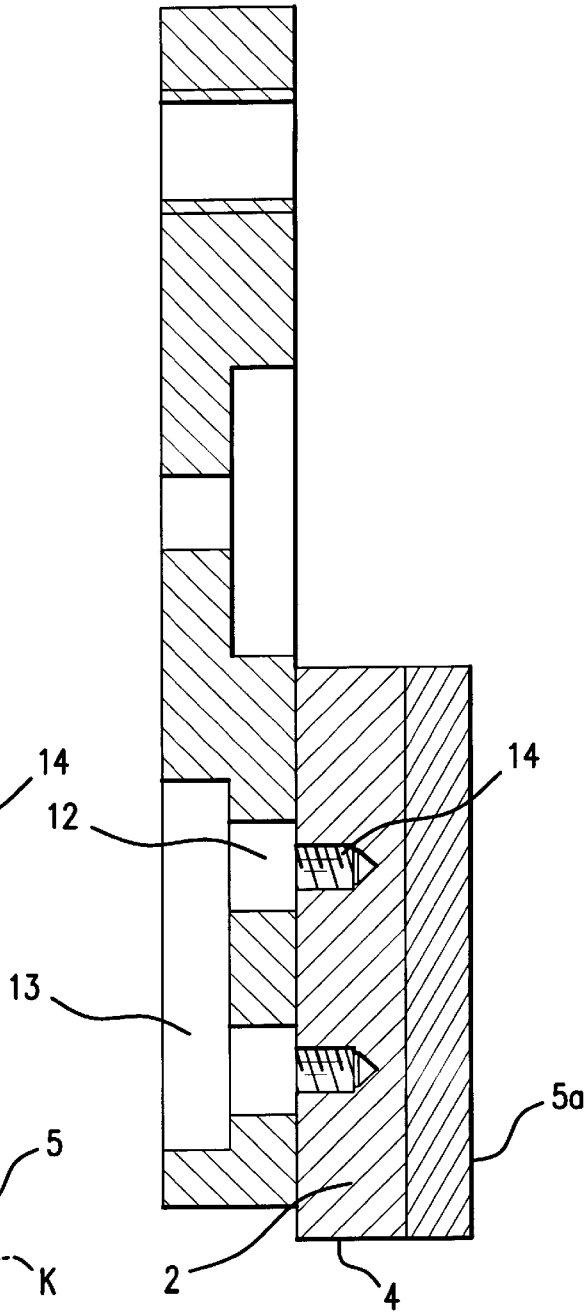
FIG. 2*a* shows a side view of the second tool with the integrated adjustment possibilities for the lateral distance X, the holding surface being coated with a plastic.

The structure of FIG. 2*a* is basically identical with that of FIG. 2 with the difference that the underside of 5*a* of the second tool 2 is constructed flat. The underside 5*a* may consist of a coating of a material, such as plastic or metal; likewise, a solid construction of the tool from one material is possible, so that the underside, as in FIG. 2, consists of the basic material of the second tool, the underside, however, being flat. Moreover, the underside 5*a* of the second tool may be hardened, for example, by nitriding, laser surface hardening or carburizing.

Figure 3:
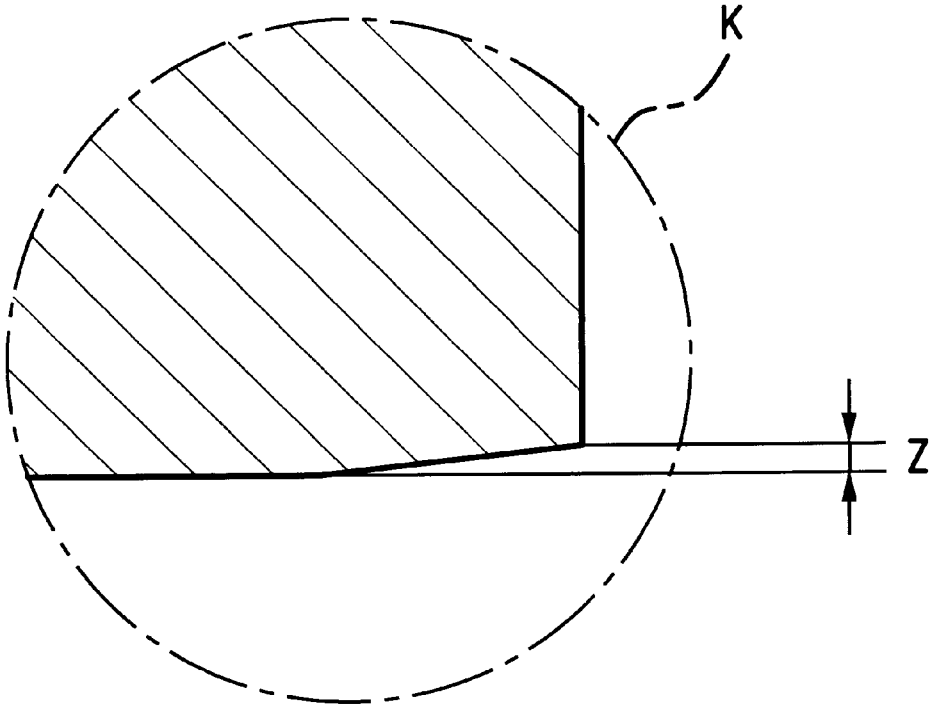
FIG. 3 shows an enlarged section K of the second tool of FIG. 2.

FIG. 3 shows the detail K of FIG. 2, the dimension Z being the distance of the second tool 2 from the workpiece surface. Penetration of the second tool into the surface of the workpiece 10 is prevented by the distance Z in that, due to the tapering of the holding surface 5, the force, which is applied to the workpiece, also decreases so that impression traces do not remain behind on the surface of the workpiece 10. However, this precaution is necessary only if the material hardness of the workpiece is less than the material hardness of the tool or if the contacting force is very large. As already described, a flat plastic or metal surface can also be used instead of the contour.

Figure 4:
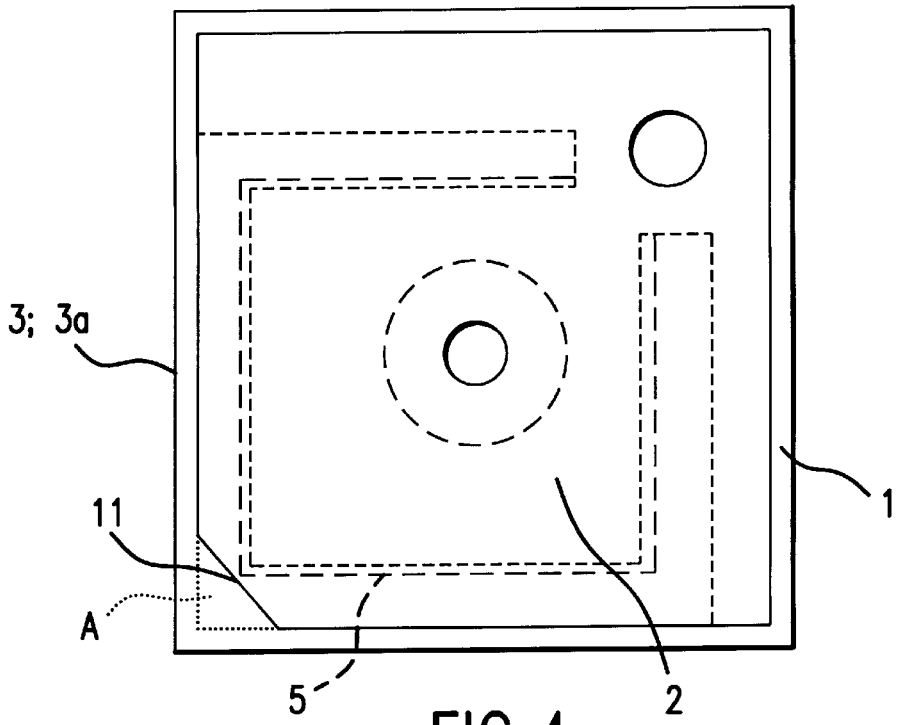
FIG. 4 shows a plan view of the upper side of the second tool without possibilities for adjusting the lateral distance, the holding surface consisting of a metallic material.

FIG. 4 shows a plan view of an example of the second tool 2, which does not have an adjustment device. In this case, the surface region A is primarily responsible for the quality of the shaping since, due to the size of the surface region A or of the corresponding surface 11 of the tool, a region of the workpiece, which is to be shaped, is not covered and thus not exposed to a force. Due to this absence of stress, the workpiece can flow in this region in accordance with the force applied by the third tool and the desired corner can be formed. Furthermore, the holding surface 5, which is shown by dashes, extends frame-like along the corner that is to be shaped and into the back region of the second tool 2, there being a distance between its free end sections. The two end sections can, however, also be connected with one another.

Figure 5:
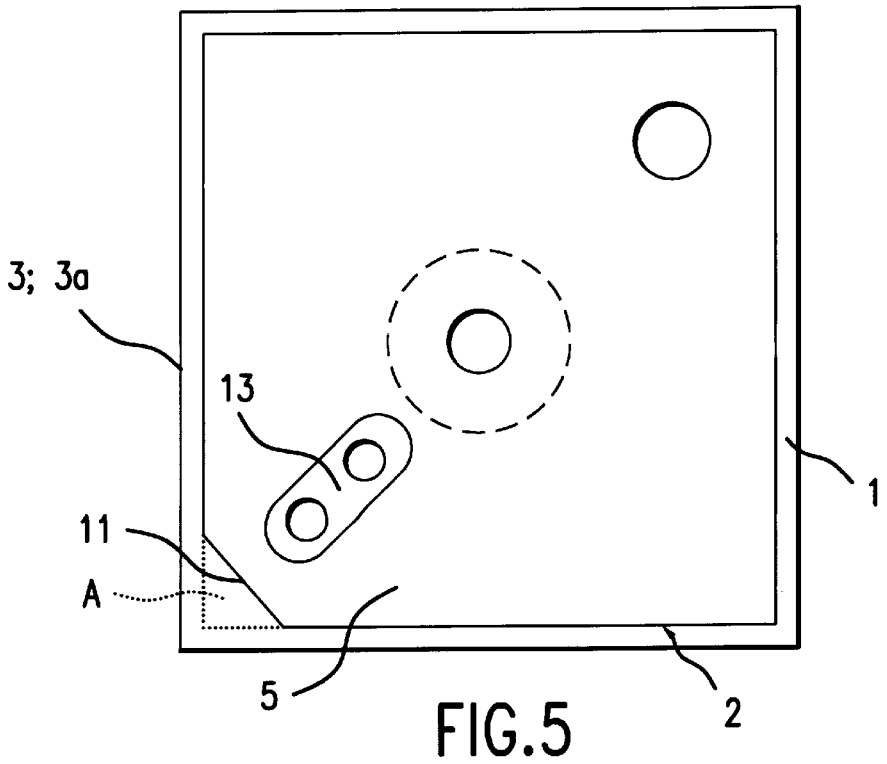
FIG. 5 shows a plan view of the upper side of the second tool with possibilities for adjusting the lateral distance, the holding surface consisting of a metallic or a plastic material.

FIG. 5 shows a plan view of the second tool, as in FIG. 4, with the difference that the underside (FIG. 2*a*) is constructed flat and that the tool has an adjustment device 13. The adjusting device 13 is realized, as shown in FIG. 2, by an elongated hole, which is made in the upper side of tool 2 and which can be engaged by adjusting screws (not shown). Due to the symmetrical arrangement of the elongated hole along the bisector of the corner angle, it is possible to displace the two parts, forming the tool 2, laterally against one another in both horizontal directions by equal amounts, in order to set the dimension X. The amount to be set is given in Table 1.

What is claimed is:

1. An apparatus for use in shaping panel-shaped workpieces in conjunction with a bending tool, the apparatus comprising:

a first and a second tool between which the workpiece is clampably receivable, the second tool having a holding surface disposed to contactingly engage the workpiece, said first tool and said second tool each including vertical side surfaces aligned along convergent planes intersecting one another at a corner angle, each of the vertical side surfaces of said first tool being laterally offset from a superimposed one of the vertical side surfaces of said second tool by a horizontal dimension corresponding at most to five times a thickness of the panel-shaped workpiece; and the second tool including a further vertical surface aligned along a further plane extending between said vertical side surfaces at an inclined angle thereto and positioned on said second tool to correspond to a corner region in which the panel-shaped workpiece is to be shaped into a corner when the workpiece is clamped between said first and second tools, such that the second tool does not overlay the workpiece in said corner region.

2. The apparatus according to claim 1, wherein the horizontal dimension is adjustable as a function of the thickness and an edge height of the workpiece.

3. The apparatus according to claim 1 or 2, wherein the workpieces are metallic panels, sheets or foils.

4. The apparatus according to claim 1 or 2, wherein the holding surface of the second tool includes a plastic coating or consists of a metallic material and is flat.

5. The apparatus according to claim 4, wherein the plastic coating is comprised of polyethylene.

6. The apparatus according to claim 1 or 2, wherein an end region of the holding surface is inclined in such a manner that a free edge is spaced at a lesser distance from the workpiece.

7. The apparatus according to claim 1, wherein the second tool is shiftable exclusively in a vertical direction.

* * * * *